US007572113B2

(12) United States Patent
Romanyszyn et al.

(10) Patent No.: US 7,572,113 B2
(45) Date of Patent: Aug. 11, 2009

(54) METHODS AND APPARATUS FOR PUMPING AND DISPENSING

(75) Inventors: Michael T. Romanyszyn, San Antonio, TX (US); Basil F. Girjis, San Antonio, TX (US); Alfred A. Schroeder, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 717 days.

(21) Appl. No.: 11/085,370

(22) Filed: Mar. 21, 2005

(65) Prior Publication Data

US 2006/0208002 A1 Sep. 21, 2006

(51) Int. Cl.
*F04B 17/03* (2006.01)
*F04B 43/08* (2006.01)

(52) U.S. Cl. ..... 417/360; 417/477.1; 417/3

(58) Field of Classification Search ..... 417/360, 417/474, 477.11, 479, 63, 477.1
See application file for complete search history.

(56) References Cited

U.S. PATENT DOCUMENTS

| | | | | |
|---|---|---|---|---|
| 4,103,983 | A | 8/1978 | Morrison et al. | |
| 4,349,133 | A * | 9/1982 | Christine | 222/183 |
| 4,991,745 | A | 2/1991 | Brown | |
| 5,033,655 | A | 7/1991 | Brown | |
| 5,213,236 | A | 5/1993 | Brown et al. | |
| 5,339,995 | A | 8/1994 | Brown et al. | |
| 5,377,877 | A | 1/1995 | Brown et al. | |
| 5,409,144 | A | 4/1995 | Brown | |
| 5,413,252 | A | 5/1995 | Magnus | |
| 5,439,143 | A | 8/1995 | Brown et al. | |
| 5,558,507 | A | 9/1996 | Magnus | |
| 5,735,436 | A | 4/1998 | Schroeder et al. | |
| 5,803,312 | A | 9/1998 | Credle, Jr. et al. | |
| 5,928,177 | A | 7/1999 | Brugger et al. | |
| 6,003,733 | A | 12/1999 | Wheeler | |
| 6,016,935 | A | 1/2000 | Huegerich et al. | |
| 6,089,418 | A | 7/2000 | Gaiser et al. | |
| 6,106,249 | A * | 8/2000 | Barak | 417/474 |
| 6,325,115 | B1 | 12/2001 | Cowland et al. | |
| 6,637,471 | B2 | 10/2003 | Luehrsen | |
| 6,742,992 | B2 * | 6/2004 | Davis | 417/45 |
| 6,764,284 | B2 | 7/2004 | Oehman, Jr. | |
| 2003/0012669 | A1 | 1/2003 | Kawashima | |
| 2004/0168466 | A1 | 9/2004 | Landers et al. | |

FOREIGN PATENT DOCUMENTS

| | | |
|---|---|---|
| DE | 4227062 C1 | 3/1994 |
| EP | 1861319 | 9/2008 |
| WO | WO2006/102263 | 9/2006 |

OTHER PUBLICATIONS

AVC Co. "Motor Slide Bases", http://web.archive.org/web/20050214045641/http://avccomponents.co.uk/slidebases.html, Feb. 14, 2005, Internet by AVC Co.

* cited by examiner

*Primary Examiner*—Charles G Freay

(57) ABSTRACT

Methods and apparatus for pumping and dispensing are provided in which a peristaltic pump (16, 64) pumps liquid from a package (12), and may be integrated in a dispenser (10). The peristaltic pump (64) is adapted for improved accuracy, cleaning, and maintenance. Also provided are improved tubes (18) for peristaltic pumping that are coupled to self-sealing dispensing valves (92, 104, 110, 120).

12 Claims, 5 Drawing Sheets

METHODS AND APPARATUS FOR PUMPING AND DISPENSING

TECHNICAL FIELD OF THE INVENTION

This invention relates generally to the movement of liquids, and more particularly to methods and apparatus for pumping and dispensing liquids or semi-liquids such as, without limitation, concentrates, syrups, beverages, milks, cheeses, condiments, soups, sauces, pharmaceuticals, and other edible or drinkable products.

BACKGROUND OF THE INVENTION

Many dispensers exist for dispensing liquids. Some dispensers mix one liquid, such as a juice or syrup, with another, such as water, to form a finished product. Others, such as some cheese dispensers or pharmaceutical dispensers, need not perform such mixing. Whatever the application, it is important that the dispensers perform reliably, that they dispense the correct amount of liquids, and that they are cost effective (among other considerations).

Unfortunately, many problems exist with existing dispensers. For example, in some dispensers, the accuracy of the pumping is low, resulting in poor quality or high costs, or both. Also, in some dispensers, there are high failure rates in the pumping mechanism. Also, the cost of the dispensers or the packaging for the liquid to be dispensed is often too high. Another area of concern is cleanliness; many dispensers are hard to clean. Still other issues arise with the difficulty with which the liquid packaging is loaded into and removed from the dispenser, and the dripping that can occur with such loading and removal. Indeed, attempts to prevent dripping often add unwarranted cost, and can cause system failures where they require a user to remember to move a valve from a closed to an open position after loading of a new package.

Therefore, a need has arisen for methods and apparatus for pumping and dispensing which overcome limitations of prior art systems.

SUMMARY OF THE INVENTION

In accordance with the teachings of the present invention, methods and apparatus for pumping and dispensing are provided which eliminate or substantially reduce the problems associated with prior art systems.

In one aspect of the present invention, a pump assembly is provided that includes a base having an electrical connector, a motor housing engaged with the base and the electrical connector, the motor housing adapted for sliding disengagement from the base and the electrical connector, the motor housing providing a substantially water-tight seal around a motor, wherein electricity is supplied to the motor through the electrical connector, and a peristaltic pump coupled to the motor, the peristaltic pump adapted for quick disconnect from the motor.

In a particular embodiment, the pump assembly includes a performance identifier coupled to the peristaltic pump, and a sensor operable to sense the performance identifier and generate a signal in response to the performance identifier, wherein the motor is controlled in response to the signal. In particular embodiments, the peristaltic pump is a wave pump having a rotor assembly, and the performance identifier is a magnet rotating with the rotor assembly. Also, a home identifier spaced apart from the performance identifier may be provided, and the sensor is further operable to sense the home identifier.

In another aspect of the present invention, a peristaltic pump includes a tube through which a material to be pumped flows, a motor, one or more compression heads coupled to the motor and adapted to compress the tube for pumping the material in a desired flow direction, a performance identifier coupled to the peristaltic pump, a sensor operable to read the performance identifier and generate a signal in response to the performance identifier, and wherein the motor is controlled in response to the signal. In a particular embodiment, the performance identifier identifies a deviation of the pump's performance from a target pumping performance, and the speed of the motor is controlled based on the identified deviation to achieve enhanced pumping performance. The performance identifier may be a magnet rotating with the rotor assembly. Also, a home identifier spaced apart from the performance identifier may be provided, and the sensor is further operable to sense the home identifier.

In another aspect of the present invention, a peristaltic pump for pumping liquid through a flexible tube is provided which includes a plurality of pushers operable to compress the flexible tube and thereby pump liquid through the flexible tube, a rotor assembly coupled to the pushers, such that rotation of the rotor assembly moves the pushers toward and away from the flexible tube in a wave-like motion, wherein the rotor assembly has an axis of rotation, a door providing access to the pushers for insertion and removal of the flexible tube, the door closing with a closing latch, a pressure plate opposite the flexible tube from the pushers and against which the pushers compress the flexible tube, the pressure plate being coupled to the door with a spring loaded mount such that the pressure plate is operable to travel toward and away from the pushers, and a fixture for holding the rotor assembly in place, such that the distance from the axis of rotation to the pressure plate is within such a tolerance as to allow the pressure plate travel to be less than about 120 thousandths of an inch.

In another aspect of the present invention, a dispenser includes a housing having a front side, a dispensing point proximate the front side of the housing, a container containing a liquid to be dispensed, a tube coupled to the container, a peristaltic pump coupled to the tube and operable to pump liquid from the container through the tube toward the dispensing point, and a self-sealing dispensing valve coupled to the tube downstream of the peristaltic pump.

In particular embodiments, the self-sealing dispensing valve is bonded to the tube, or molded as part of the tube. Also, a tamper evident seal may be provided over the self-sealing dispensing valve, and may be coupled to the self-sealing dispensing valve. In a particular embodiment, the self-sealing dispensing valve comprises a base section, a cover section, and a frangible section between the cover section and the base section, the cover section being removable from the base section at the frangible section. Also, the cover section may comprise a pull tab that facilitates removal of the cover section by tearing along the frangible section. In other embodiments, a fitting surrounds the self-sealing dispensing valve, and the tamper evident seal is coupled to the fitting. In some embodiments, the fitting carries the self-sealing dispensing valve. In another embodiment, the container comprises a flexible package located within the housing and which has a bottom portion and a front portion, and wherein the tube is coupled to the bottom portion of the container near the front portion of the container.

In another aspect of the present invention, the dispenser includes a cold source, a first water line passing through the cold source and coupled to the dispensing point, such that the liquid and water are dispensed at the dispensing point. The water in the first water line may be carbonated water or plain water. A first water valve may be coupled to the first water line upstream of the cold source, the first water valve being operable to open in response to a dispense request. Also, a second water line may be provided which passes through the cold source and is coupled to the dispensing point, and wherein the water in the first water line is carbonated water and the water in the second water line is plain water, such that the liquid may be dispensed through the nozzle with either carbonated water or plain water. A second water valve may be coupled to the second water line upstream of the cold source, the first and second water valves being respectively operable to open in response to a respective dispense request for carbonated water or plain water dispensing. Also, the tube may be coupled to a line that passes through the cold source. The cold source may be an ice/water bath or a cold plate, without limitation.

Important technical advantages are provided herein, including, without limitation, the provision of a peristaltic pump mechanism that is easy to remove, for cleaning, service and maintenance, and which has improved accuracy. Another important technical advantage is that a performance identifier is provided on a peristaltic pump for adjusting its control for better pumping performance. Still another technical advantage is provided in that self-sealing dispensing valves are coupled to tubes through which liquids are pumped, thus preventing dripping without the need for user action.

BRIEF DESCRIPTION OF THE DRAWINGS

Reference is made in the description to the following briefly described drawings, wherein like reference numerals refer to corresponding elements.

DETAILED DESCRIPTION OF THE INVENTION

Figure 1:
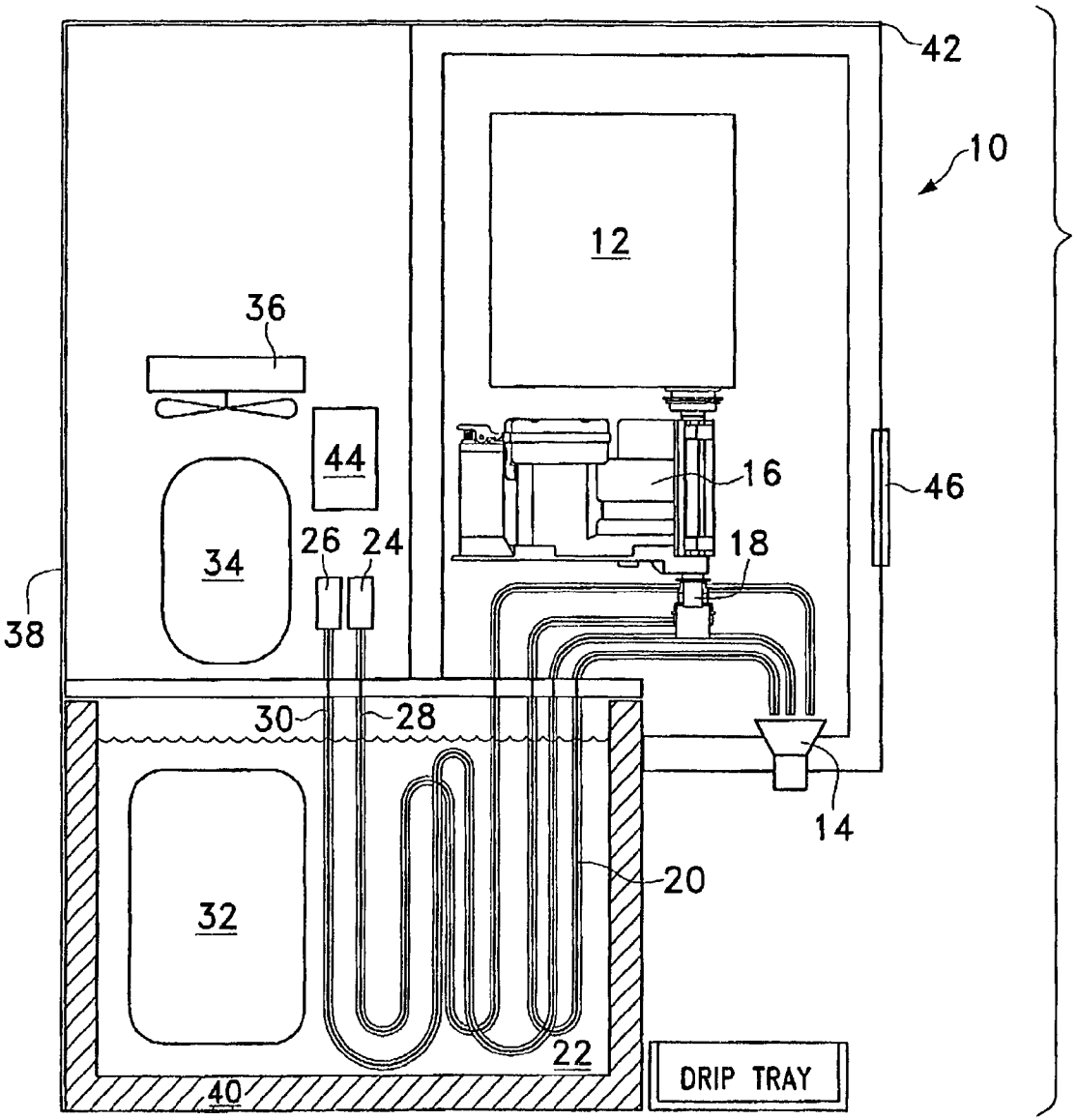
FIG. 1 is a schematic illustration of one embodiment of a dispenser according to one aspect of the teachings of the present invention.

FIG. 1 illustrates a dispenser 10 used to dispense a liquid from a package 12. In the particular example illustrated, the liquid is a drink concentrate, such as a soft drink syrup, a juice concentrate, or a milk concentrate, and is to be mixed with plain or carbonated water to form a finished drink. The liquid is dispensed through a dispensing point, which may be a nozzle 14, into any suitable receptacle, such as a cup (not shown). A peristaltic pump 16 pumps the liquid from the package 12 toward nozzle 14. The liquid is pumped through a tube 18, which is coupled to the package 12 directly or through a fitment or any suitable coupling approach. Tube 18 may also be coupled directly to the nozzle 14, or it may be coupled to the nozzle 14 through intermediate steps. For example, as shown in FIG. 1, the tube 18 may be coupled to a line 20, which runs through an ice/water bath 22 for cooling the liquid. Line 20 may take a circuitous path through the ice/water bath 20, such as, without limitation, a coiled path.

Also shown in FIG. 1 are water valve 24 and soda valve 26. These valves are used to control the flow of plain or carbonated water to the nozzle 14, which is mixed with the liquid from the package 12 to form finished drinks. Water from the valves 24 or 26 may be coupled directly to the nozzle 14, or passed through lines 28 and 30 (respectively), which pass through the ice/water bath 20. Lines 28 and 30 may take circuitous paths through the ice/water bath 20, such as, without limitation, coiled paths. Valves 24 and 26 may be located upstream of the ice/water bath 20, as shown in FIG. 1, or elsewhere, for example, between the ice/water bath 20 and the nozzle 14. Valves 24 and 26 may be any suitable valve, including, without limitation, on/off solenoid valves, flow control valves, or volumetric valves.

The ice/water bath 22 may be formed by creating an ice bank 32 by freezing water around an evaporator of a conventional refrigeration system. A compressor 34 and condenser 36 of such a system are shown schematically in FIG. 1. The dispenser 10 is generally structured with a housing 38, and includes an insulated chamber 40 for holding the ice/water bath 20. A cover 42 may be used to cover the top of the dispenser 10. Also, the package 12 and pump 16 may reside in an insulated compartment that is refrigerated by the refrigeration system. Access to the package 12 and pump 16 is provided through a door in the front of the dispenser. Although an ice/water bath 20 is shown in FIG. 1, any other suitable cooling source may be used to cool the liquid or water to be dispensed. For example, a metal cold plate could be used, wherein one or more conduits are cast into the cold plate and coupled to one or more of the lines 20, 28, and 30. With a cold plate as the cold source, ice is placed on the cold plate, causing the cold plate to cool the liquid or water passing through it. Also, the pump 16 may be located outside of the dispenser 10.

A controller 44, which may comprise, without limitation, a microcontroller or microprocessor based control system, is used to control operation of the dispenser 10. The controller 44 is coupled to the valves 24 and 26, the pump 16, the refrigeration system, and to a user interface 46. User interface 46 may be one or more switches or other input devices used to receive requests for dispenses. For example, if a carbonated beverage is requested, controller 44 controls soda valve 26 and pump 16 to dispense the proper amounts of liquid from package 12 and soda water to form the finished drink. Controller 44 may also receive inputs related to options for mixing and ratio accuracies, among other control functions. These inputs may be provided through user interface 46 or any other suitable interface (such as, without limitation, from a hand-held electronic device).

The soda (carbonated water) may be generated at a remote carbonator, or in a carbonator located within the dispenser 10. Also, the carbonator could be located within the ice/water bath 22 or other cold source.

The nozzle 14 may be any suitable nozzle, including, without limitation, a dispensing nozzle, a mixing nozzle, a multi-flavor nozzle that allows more than one flavor beverage or flavor additive to be dispensed through the same nozzle, a combination mixing chamber and dispensing nozzle, or a simple tube opening at which beverages are dispensed.

The package 12 may be located within the dispenser 10, as shown in FIG. 1, or it may be located outside the dispenser 10. Furthermore, although one liquid package 12 is shown, a plurality of liquid packages may be used for dispensing a plurality of finished drinks. With such a plurality of packages 12, a plurality of pumps 16 would also be used. Package 12 may be a flexible package, such as, without limitation, a plastic pouch, with or without an outer housing such as a cardboard box. Alternatively, and without limitation, package 12 may be a molded or extruded plastic package. Also, although plain and carbonated water circuits are shown, only one or the other could be used, and, indeed, none would be needed if the liquid is at a ready-to-dispense strength.

Figure 2:
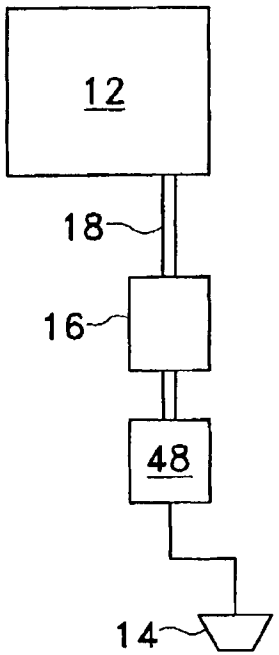
FIG. 2 is a schematic illustration of one embodiment of a dispensing configuration according to one aspect of the teachings of the present invention.

FIG. 2 illustrates one embodiment of a dispensing configuration for package 12, nozzle 14, pump 16, tube 18, and a mixing chamber 48. As shown, the tube 18 is coupled to the bottom of the package 12 near its front, which configuration improves evacuation efficiencies from the package 12. Pump 16 is positioned below the package 12, and pumps liquid to the mixing chamber 48, which may be, without limitation, a mixer such as that described in U.S. patent application Ser. No. 10/869,122, filed Jun. 16, 2004, and entitled "METHOD AND APPARATUS FOR A MIXING ASSEMBLY," which is herein incorporated by reference in its entirety. The mixture is then dispensed through nozzle 14, which may be, without limitation, simply the output tube of the mixing chamber 48.

Figure 3:
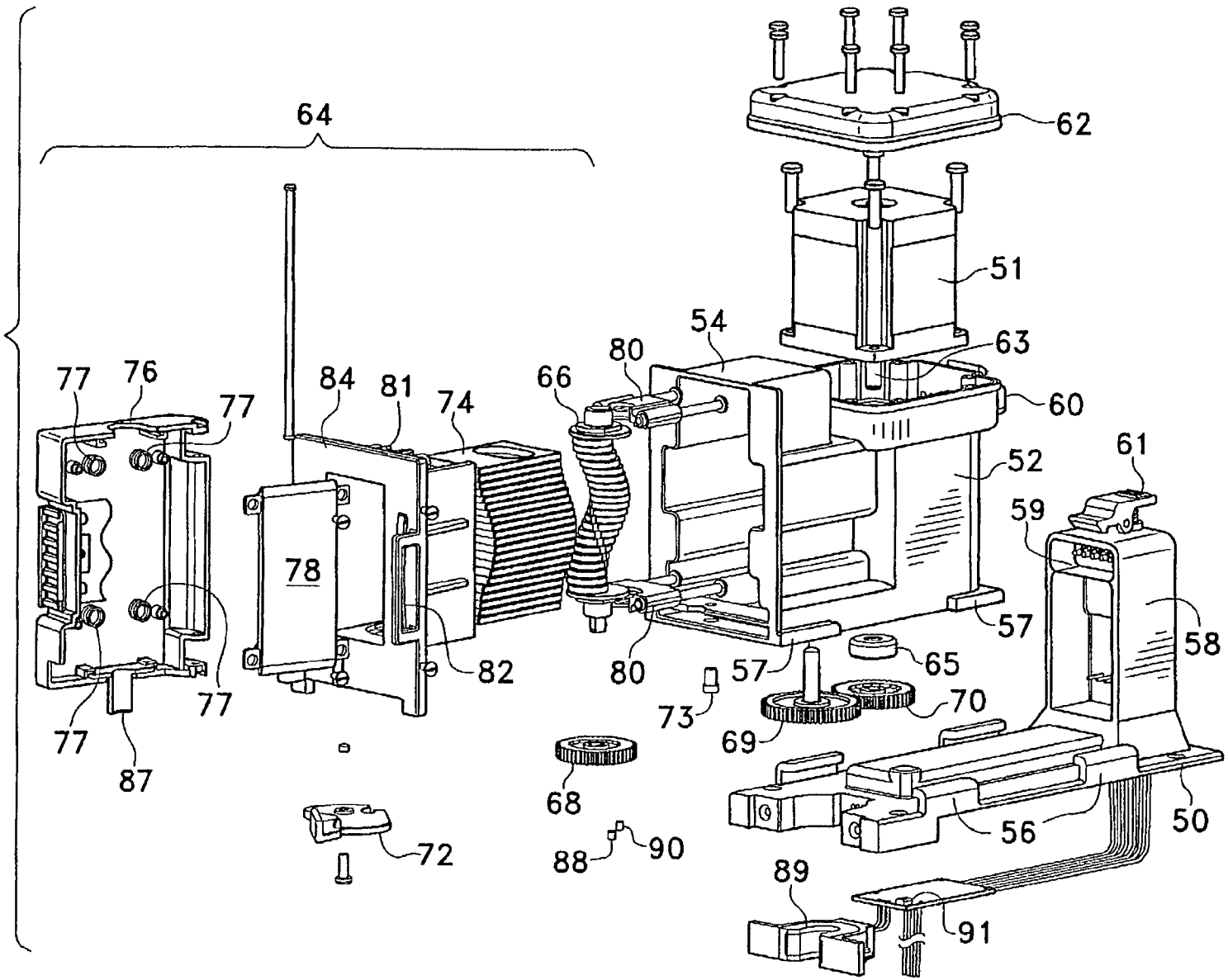
FIG. 3 is an exploded diagram of one embodiment of a pumping mechanism according to one aspect of the teachings of the present invention.

FIG. 3 is an exploded view of one embodiment of a pumping mechanism according to one aspect of the present invention. As shown, a base 50 is adapted to receive a motor housing 52 and pump housing receiver 54. In particular, the base includes guides 56 which slidingly engage tabs 57 on the motor housing 52 and pump housing receiver 54. The pump housing receiver 54 may be formed as part of the motor housing 52. An electrical connector 59 is provided on a motor housing receiver 58 of the base 50 for electrical coupling to an electrical connector 60 of the motor housing 52. The electrical connection is made as the motor housing 52 is slid into place on the base 50. The electrical connector 59 is coupled to electrical power and to controller 44, for example through the bottom of base 50. The motor housing 52 may be positively latched in place with a motor latch 61. The base 50 is preferably coupled to a dispenser, such as that shown in FIG. 1, although the base 50 and pumping mechanism may be remote from the dispenser.

A motor 51 is housed within motor housing 52, and is electrically coupled to the electrical connector 60. Housing 52 includes a motor housing cap 62 that seals the housing 52 from moisture, for example with a gasket and screws, and which is removable to allow insertion and removal of the motor. Wires in the electrical connectors are sealed against the introduction of moisture, for example by potting. Also, the male/female connection between connectors 59 and 60 is sealed against moisture with an o-ring. Although the connector 59 is shown as a female connection, and connector 60 as a male, they may be reversed. The motor housed within the motor housing 52 may be any suitable motor, including, without limitation, a stepper motor or a DC motor. A motor shaft 63 of the motor is sealed against moisture, for example with a lip seal 65. The lip seal 65 may be considered part of the motor housing 52. The use of a sealed housing avoids many motor failures, which often occur in high moisture applications, such as in connection with refrigerated dispensers.

Figure 4:
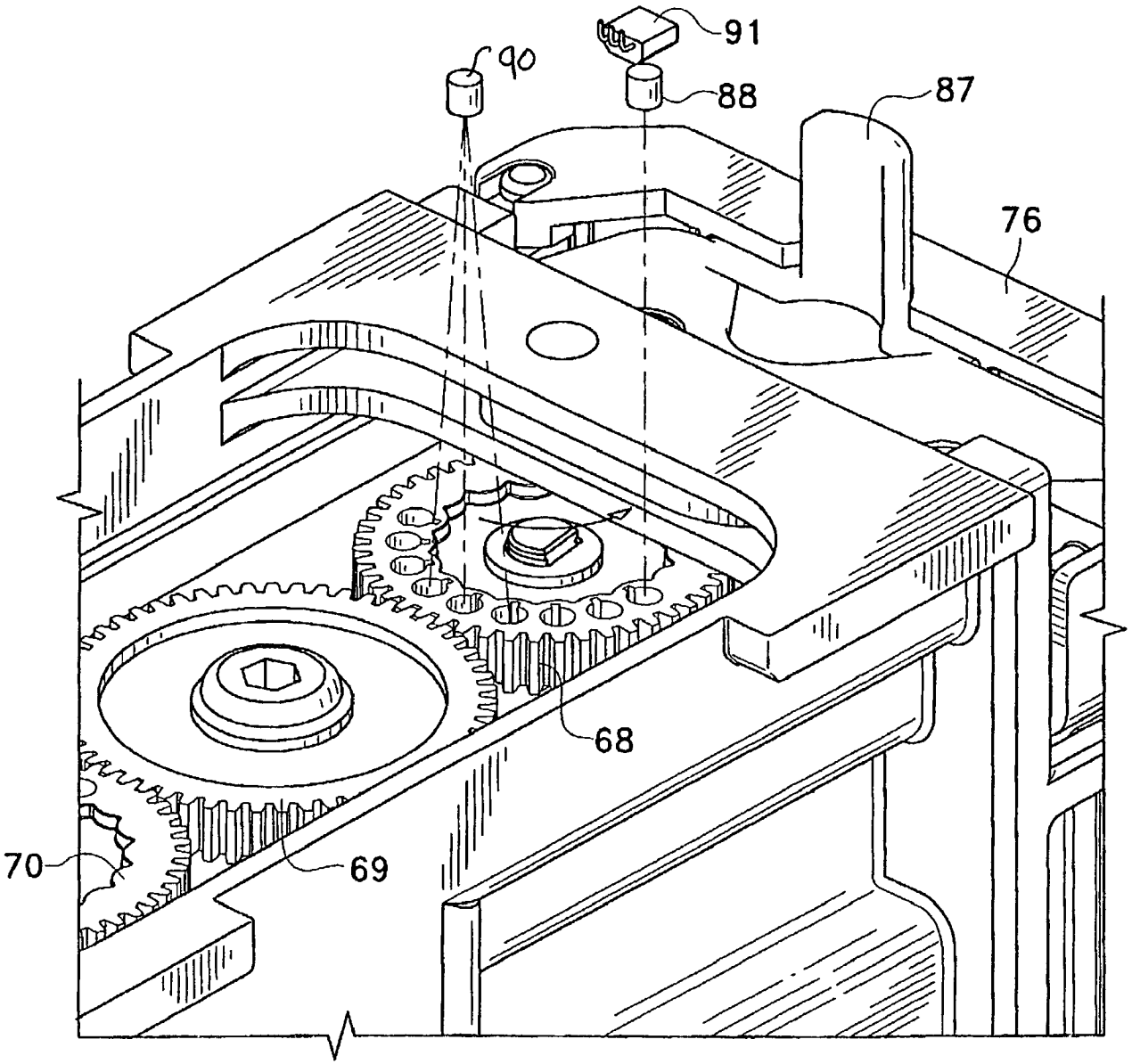
FIG. 4 is a bottom view of part of one embodiment of a pumping mechanism according to one aspect of the teachings of the present invention.

The pump housing receiver 54 includes guides which slidingly engage with a pump 64. Pump 64 is a peristaltic pump, and, as illustrated in FIGS. 3 and 4, in a particular embodiment is a wave pump. The pump 64 includes a rotor assembly 66 that couples to motor shaft 63 when the pump 64 is installed in the pump housing receiver 54. The coupling may be, for example, and without limitation, through gears 68, 69, and 70. It should be understood, however, that any peristaltic pump may be used, and coupling to the motor may be as desired. The pump 64 may be positively latched into place with a pump latch 72, which, for example and without limitation, similar to a pivoting window latch, engages a post 73 or other fixture on base 50 to latch the pump 64 firmly into pump housing receiver 54.

As illustrated by the exploded view of FIG. 3, the pump mechanism is designed so that the pump 64 may be easily removed for cleaning or replacement. In particular, the pump 64 is removed by simply opening the pump door 76, opening the pump latch 72, and sliding out the pump 64. Similarly, in the event of a motor failure, the motor housing 52 (and motor) may be quickly removed by disengaging the motor latch 61 and sliding out the motor housing. Installation of a new motor in its motor housing 52 is simple, requiring only the new motor housing 52 be slid into the base 50. It should be understood that although a particular approach has been used for the quick and easy connect/disconnect of the pump 64 and motor housing 52, and for sealing of the motor against moisture, other approaches may be used without departing from the intended scope herein.

In a particular embodiment, the pump 64 is a wave pump, such as generally described in U.S. Pat. Nos. 5,413,252 and 5,558,507, which are herein incorporated by reference in their entirety. In general, wave pump 64 includes a plurality of pushers 74 that compress a flexible tube and thereby pump liquid through the flexible tube. The pushers 74 are coupled to rotor assembly 66, such that rotation of the rotor assembly 66 moves the pushers toward and away from the flexible tube in a wave-like motion. Pump door 76 provides access to the pushers for insertion and removal of the flexible tube. Although a peristaltic wave pump is illustrated, any peristaltic pump mechanism may be used, including, without limitation, those that squeeze a tube and move fluid in the tube with one or more roller heads, sliding heads, caterpillar mechanisms, cams, disks, or other devices.

Although peristaltic pumps present many advantages, they are often inaccurate and have wide pumping variability from pump-to-pump. Many factors contribute to these problems, including the variability of relative geometries within the pumps, and variability in tube wall thickness and inner tube diameters. In wave pumps, to accommodate this variability, a spring-loaded pressure plate 78 is mounted on the inside of pump door 76, against springs 77. This pressure plate 78 prevents the pushers 74 from bottoming out against a hard stop in cases where tolerance stack ups result in the full stroke of the pushers being greater than the flexibility of the tube allows. Such bottoming out results in poor performance and high failure rates due to stresses on the motor. However, too much play in the pressure plate (that is, if its maximum travel is too great) causes rocking of the pressure plate 78 as the wave of pushers 74 operate, resulting in negative pumping in some cases.

One aspect of the present invention involves addressing these issues by controlling the relative locations of the pressure plate 78 and the rotor 66, thus allowing for a pressure plate 78 with much less play than prior art solutions, and consequently much better pumping performance. In a particular embodiment, the rotor assembly 66 is held firmly in place with a pair of bearing caps 80, which hold the rotor assembly 66 against receivers 81. Also, pump door 76 is firmly latched into place with a latch 82 extending from pump face 84. With this approach, the travel of pressure plate 78 (that is, the distance from its at-rest position to its fully-depressed position) may be limited to less than about 120 thousandths of an inch, and in a particular embodiment to less than about 70 thousandths of an inch. In a particular embodiment, some pump parts, such as the bearing caps, may be made from glass filled nylon.

Another aspect of the present invention involves addressing variability in peristaltic pumps by characterizing the performance of a pump, for example as part of a test, and then placing an identifier on the pump that is indicative of the measured performance. In particular, the main issue in pump variability is flow rate. Thus, a pump is tested (under known conditions) against a standard, ideal flow rate as part of a characterization test. The deviation in the performance of the pump from the standard is measured, and then an identifier is placed on the pump to indicate that performance. Once the pump is installed for use, the identifier is read by a sensor, which may be coupled to the base 50 (or which may be located elsewhere, for example, without limitation, on the dispenser, or pump housing receiver 54 or motor housing 52). The sensor is coupled to the controller 44, which then controls the motor by adjusting its speed in response to the identified performance. For example, if the pump was characterized as pumping 2% less than the standard, then the identifier would indicate that characteristic, and the controller would speed up the motor from its standard speed to make up for the 2% deficiency.

In a particular embodiment, as shown in the open bottom view of FIG. 4, the identifier may be a pair of magnets coupled to gear 68. A first magnet 88 serves as a home identifier, and a second magnet 90, which is angularly spaced apart from the home identifier, serves as a performance identifier, with the angular separation indicative of the performance characteristic of the pump. A sensor 91, which, without limitation, may be a hall-effect sensor, senses the angular separation of the performance identifier 90 and the home identifier 88, as the pump is operated. As shown, the performance identifier magnet 90 may be placed in any one of a plurality of positions, depending on the performance characteristic of the pump. These plurality of positions indicate predetermined deviations from standard performance. For example, the four locations closest to the home identifier may represent deviations of +2.5%, +5.0%, +7.5% and +10.0%, and the next four locations may represent deviations of −2.5%, −5.0%, −7.5% and −10.0%. The identifier may be any suitable identifier, including, without limitation, a radio frequency identification circuit, a bar code, and voids or tabs on the gear, or a washer coupled to the gear. Of course, the sensor must be chosen to read the identifier.

In the particular embodiment shown, the possible locations for the identifiers are all located within less than 180 degrees, so as to ensure that the home identifier will be identified distinctly from the performance identifier. That is, as the rotor assembly 66 turns, there will be a shorter time interval between the sensing of the home identifier and then the performance identifier, than between the sensing of the performance identifier and then the home identifier. This time difference may be used to distinctly identify either identifier. However, it should be understood that this is only one approach, and any other approach for distinguishing the identifiers may also be used, and the identifiers do not have to be located within 180 degrees of each other.

The identifiers discussed above may also be used to confirm that the pump 64 is pumping when signals are being sent to the motor. If the pump is not pumping, then the motor has failed, or the pump/motor coupling has failed or is not engaged, or there is some other problem. One aspect of the present invention uses the sensor 91 to read whether the rotor assembly 66 is turning by monitoring the movement of the identifiers. If the rotor assembly 66 is not turning when it is supposed to be, then the motor is stopped. Of course, an appropriate error signal may be generated, if desired. Also, the home identifier is used to identify a home location (commonly called "top dead center") of the rotor assembly 66, and thus of the wave of pushers 74. With this information, more precise pumping may be achieved, because the pump may be stopped (and thus started) at a known location. Also, pump 64 may include a tab 87 to hold tube 18 firmly against a sensor 89. Tab 87 should be sized based on the diameter of the tube to be used with the pump 64. The sensor 89 may be, without limitation, a sensor such as that described in U.S. patent application Ser. No. 11/021,403, filed Dec. 22, 2004, and entitled "METHOD AND APPARATUS FOR A PRODUCT DISPLACEMENT SENSING DEVICE," which is herein incorporated by reference in its entirety. Such a sensor senses displacement in the flexible tube 18 caused by pumping of the liquid.

Another aspect of the present invention involves the prevention of leaking from the tube 18 during storage, use, or replacement of spent packages 12. When the liquid in package 12 is depleted, the package must be removed and replaced with a new package 12. This is accomplished by opening the door 76 of the pump 64, uncoupling the tube 18 from whatever it is coupled to (for example, line 20 or mixing chamber 48), and removing the package 12 (to which tube 18 is coupled). Then, a new package 12, having a new tube 18, is installed by placing the package 12 in its receptacle, placing the tube in the pump 64, closing the door 76, and coupling the tube 18 to, for example, line 20 or mixing chamber 48. Unfortunately, during this process, liquid remnant in the spent package and tube often leaks out of the tube. Also, when loading a new package, dripping can occur. Prior art attempts to address this dripping problem involve the use of manually operated check valves at the end of the tube. These are unsatisfactory, however, because of their cost, and because the users often forget to open them, causing pump failures or significant messes, or do not understand to close them, rendering them useless against the dripping problem they were intended to solve. Moreover, it is important to prevent dripping even after a package is installed, for example when a dispenser is idle.

To address the dripping problem, one aspect of the present invention involves coupling a self-sealing dispensing valve to the tube 18, as illustrated in FIGS. 5-10. The self-sealing dispensing valve may be any suitable self-sealing dispensing valve, but in a particular embodiment is a valve such as those disclosed in U.S. Pat. No. 5,213,236, issued on May 25, 1993 to Brown et al., and entitled "DISPENSING VALVE FOR PACKAGING." That patent is herein incorporated, in its entirety, by reference. Such a self-sealing dispensing valve allows liquid to be dispensed during pumping operations without restricting flow, because it has a relatively low opening pressure and negligible pressure drop across the valve. And, once pumping ceases, the self-sealing dispensing valve automatically seals, thus providing a relatively sharp cut-off and preventing leaking and dripping, both while the package 12 and tube 18 are installed in the dispenser and while they are being removed and loaded into the dispenser, without the need for any action by the user. The self-sealing dispensing valve may be formed from a resiliently flexible material, and in particular may be formed from a silicone rubber that is substantially inert. For illustration only, and without limitation, in one example the tube inside diameter is about 10 millimeters, and the self-sealing dispensing valve should be able to seal against an internal pressure of about 75 pounds per square inch in a 2.5 gallon flexible bag of liquid.

Figure 5:
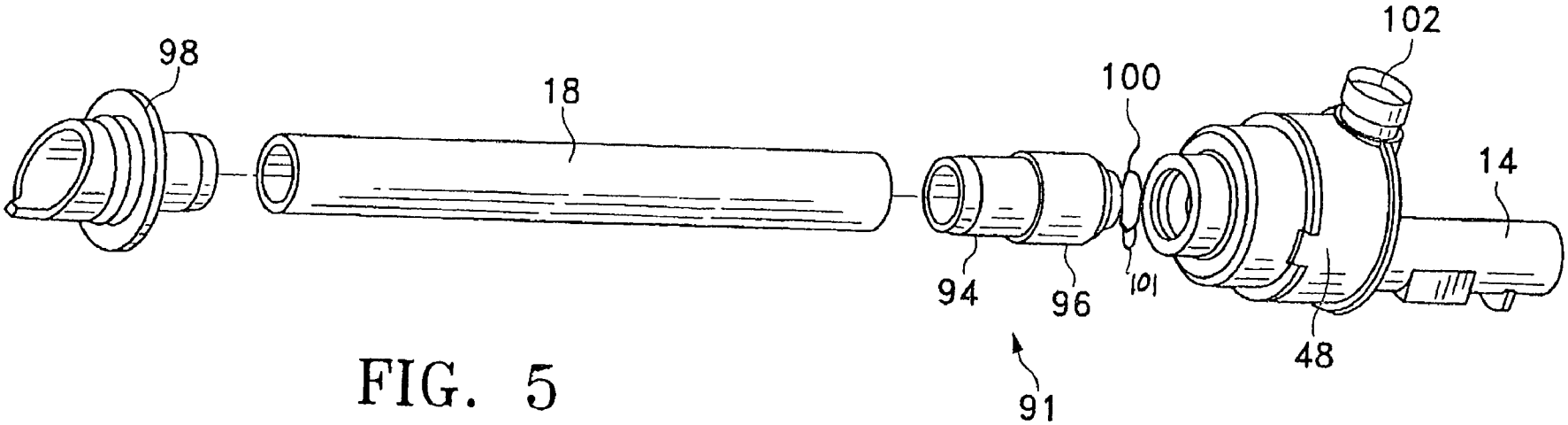
FIG. 5 is an exploded view of one embodiment of a tube with a self-sealing valve according to one aspect of the teachings of the present invention.
Figure 6:
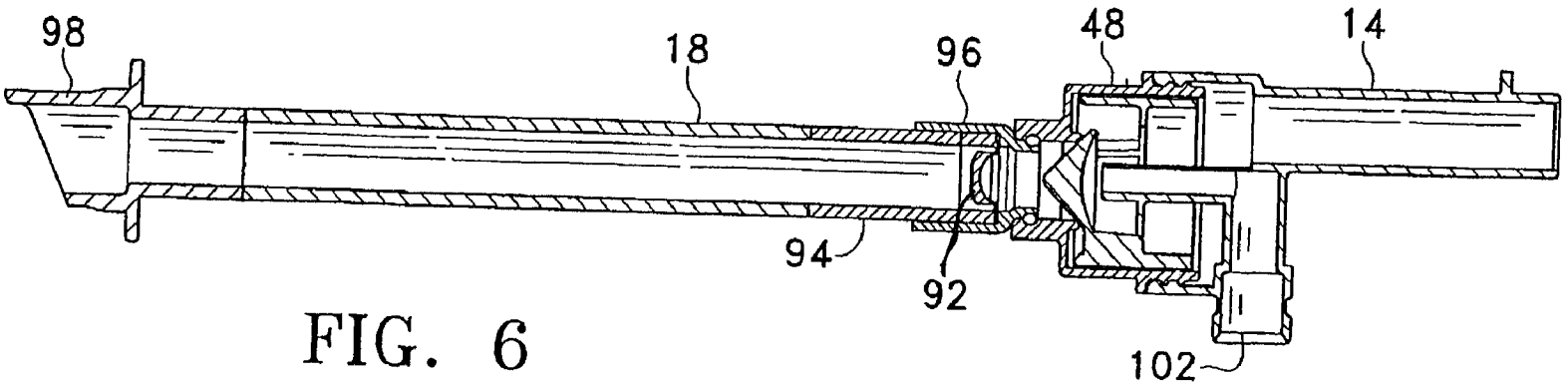
FIG. 6 is a cross-sectional view of one embodiment of a tube with a self-sealing valve according to one aspect of the teachings of the present invention.

One embodiment of a self-sealing dispensing valve arrangement is shown in FIGS. 5 and 6. As shown, a two-piece fitting 91 carries the self-sealing dispensing valve 92 and couples it to the tube 18. Fitting 91 includes a tube engaging section 94 and a downstream section 96. Tube engaging section 94 is coupled to the tube 18. For example, and without limitation, the section 94 may be located inside the tube 18. Section 94 may be bonded to the tube 18 (although this is generally not necessary), for example, without limitation, with glue. Downstream section 96 is coupled to downstream components, for example line 20 of FIG. 1 or, as shown in FIG. 5, mixing chamber 48. Sections 94 and 96 snap together (or are otherwise joined), holding the self-sealing dispensing valve 92 in place. A pouch piercing fitment 98 is shown on the upstream end of tube 18, for piercing of a flexible pouch and engagement with a mating fitment located in the pouch. It should be understood that this fitment 98 is an example only, and in many cases the tube 18 will be coupled directly to the package 12, or coupled to the package 12 though a non-piercing fitment, for example, and without limitation. A tamper evident seal 100 is sealed to downstream section 96 of fitting 91 to help ensure product integrity. Tamper evident seal 100 may be affixed in any suitable manner, including, without limitation, with induction sealing or adhesives. Tamper evident seal 100 may include a tab 101 extending outward from the section 96 to assist a user in grasping it for easy removal. As also shown in FIG. 5, mixing chamber 48 includes an inlet 102 for receiving a mixing fluid, such as water.

Figure 7:
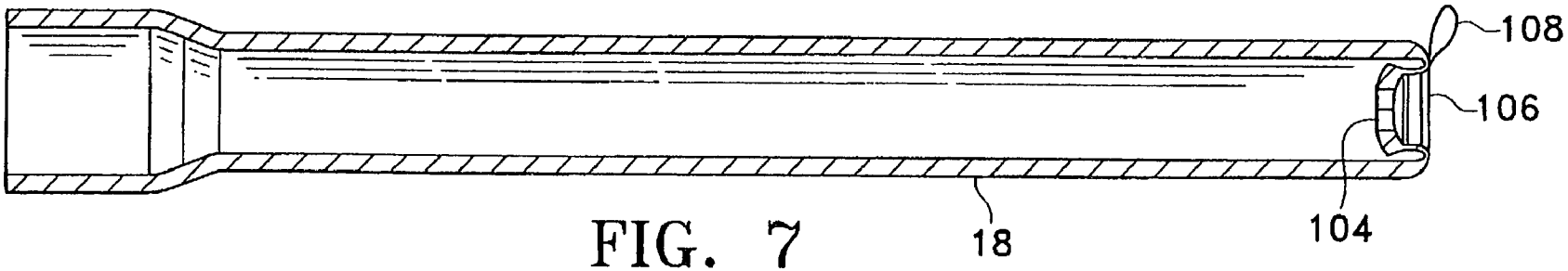
FIG. 7 is a cross-sectional view of another embodiment of a tube with a self-sealing valve according to one aspect of the teachings of the present invention.
Figure 8:
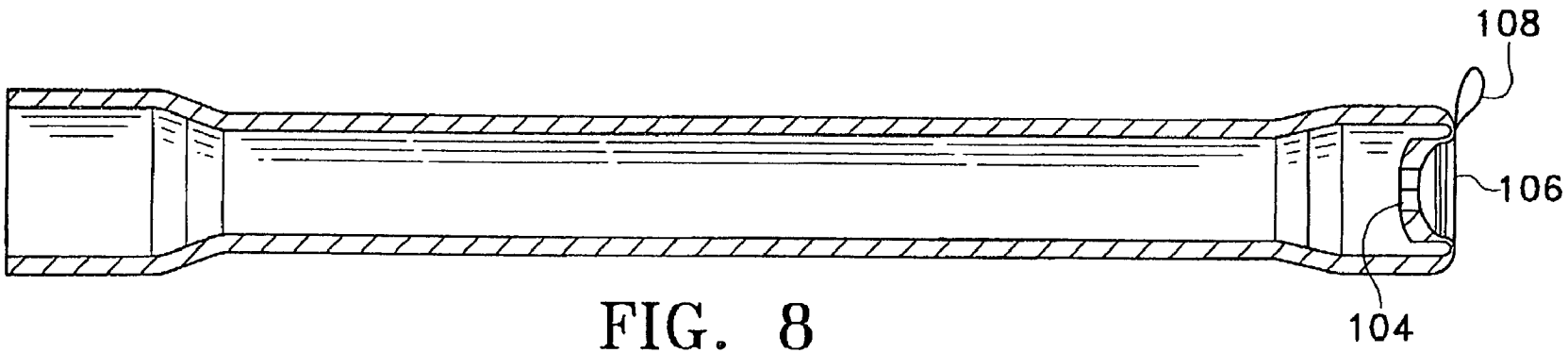
FIG. 8 is a cross-sectional view of another embodiment of a tube with a self-sealing valve according to one aspect of the teachings of the present invention.

FIGS. 7 and 8 illustrate other embodiments of self-sealing dispensing valve arrangements according to other aspects of the present invention. In FIGS. 7 and 8, a self-sealing dispensing valve 104 is integrated directly with the tube 18, for example, and without limitation, by molding it as part of the tube 18, welding, or by bonding, for example with adhesive. As shown in FIG. 8, the diameter of the tube 18 may be increased at the end of the tube 18 that includes the self-sealing dispensing valve 104. This diameter increase may be employed, for example, to accommodate larger diameter self-sealing dispensing valves. Similarly, the diameter at the valve end may be decreased or maintained. A tamper evident seal 106 is sealed to the end of the tube/valve combination of FIGS. 7 and 8. Tamper evident seal 106 may include a tab 108 extending outward from the seal to assist a user in grasping it for easy removal.

Figure 9:
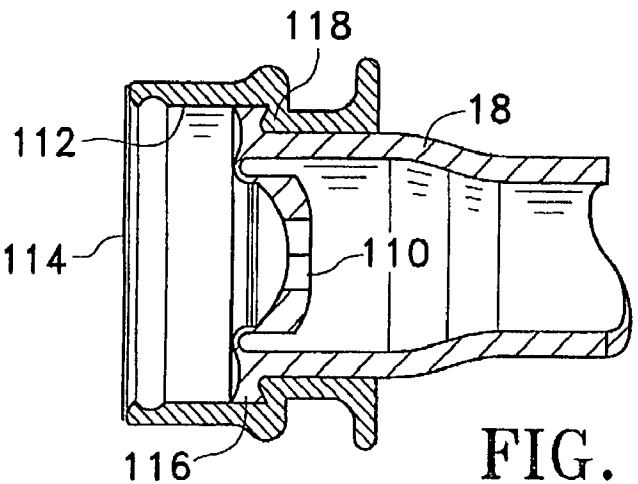
FIG. 9 is a cross-sectional view of another embodiment of a tube with a self-sealing valve according to one aspect of the teachings of the present invention.

FIG. 9 illustrates another embodiment of a self-sealing dispensing valve arrangement according to another aspect of the present invent. As illustrated in FIG. 9, a self-sealing dispensing valve 110 is integrated directly with the tube 18, for example, and without limitation, by molding it as part of the tube 18, welding, or by bonding, for example with adhesive. A fitting 112 surrounds the self-sealing dispensing valve 110, and a tamper evident seal 114 is affixed to the fitting 112. In a particular embodiment, tube 18 is formed with a flange 116 that engages a matching shoulder 118 of fitting 112. Fitting 112 is assembled to the tube 18 by sliding it onto the tube 18 from the tube end that is opposite the self-sealing dispensing valve 110. The fitting 112 is advanced along the tube 18 until its shoulder 118 meets the flange 116. The tamper evident seal 114 (which may have a tab such as discussed above to assist in removal) is applied to the fitting 112 after the fitting 112 is in place at the valve end of tube 18.

Although particular examples are described for holding the self-sealing dispensing valve, any suitable approach may be used. For example, without limitation, the self-sealing dispensing valve may be held in a fitting by a retaining ring or by bonding (such as, without limitation, by gluing) the self-sealing dispensing valve to the fitting. Such a fitting is coupled to the tube 18 in any suitable way.

Figure 10:
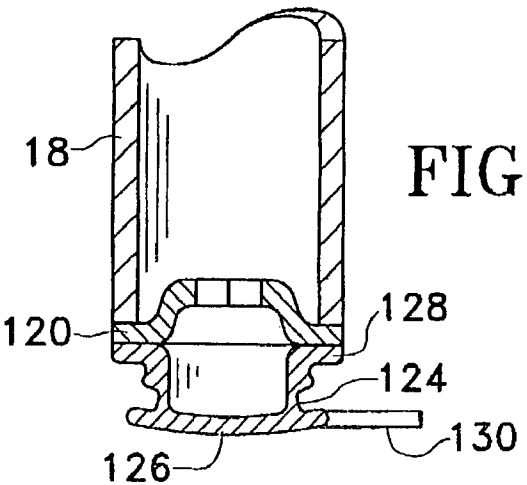
FIG. 10 is a cross-sectional view of another embodiment of a tube with a self-sealing valve according to one aspect of the teachings of the present invention.

FIG. 10 illustrates another embodiment of a self-sealing valve and tube combination according to another aspect of the present invention. As shown in FIG. 10, a self-sealing dispensing valve 120 is integrated with a tube 18, as discussed in any of the examples above. A tamper evident seal 122 is applied to the valve 120, or molded as part of the valve 120. The tamper evident seal 122 includes a frangible (or thin) section 124 that separates a cover section 126 from a base section 128. The tamper evident seal is broken by separating the cover section 126 from the base section 128 by breaking (tearing at) section 124. In a particular embodiment, the tamper evident seal is broken by a user grasping and pulling a pull tab 130 that is formed as part of section 126. Pulling at the pull tab 130 allows tearing along the frangible section 124. In a particular embodiment, the tamper evident seal 122 is applied to the valve 120, for example, and without limitation, by welding or bonding. As another example, the tamper evident seal 122 may comprise a conical shaped cover section coupled to the valve 120. The conical shaped cover section may be in the form of a bound spiral with a tab at its top, which unwinds as the tab is pulled, thus uncovering the valve. The base of the conical cover section is thin so as to allow it to be torn from the valve 20. These examples of tamper evident seals are exemplary only, and any suitable seal may be used, for example, and without limitation, one which includes twist tabs for breaking the seal.

In any of the embodiments shown in FIGS. 5-10, the valve end of the tube 118 may be coupled to a downstream element, such as, without limitation, nozzle 14, line 20, or mixing chamber 48. This coupling may be accomplished by any suitable approach, including, without limitation, by snap fitting any of the valve-end fittings of FIGS. 5, 6, 9, and 111 into a receiving fitting in the downstream element, or by simply inserting the valve end (whether it includes a fitting as in FIGS. 5, 6, and 9 or not as in FIGS. 7, 8, and 10) into a receiving port of the downstream element. In many applications, such simple insertion provides adequate sealing engagement during pumping, and in particular with embodiments such as those of FIGS. 7, 8, and 10, the flexible tube 18 expands with pressure during pumping, thus self sealing into the downstream element.

In any of the embodiments discussed above, the tube may be molded or extruded. Also, in any of those embodiments, the diameter of the tubes may be varied, for example at the valve end, or at the upstream end. For example, the tubes may have an expanded diameter portion at the upstream end to prevent pump starving.

Although the dispenser 10 shown in FIG. 1 is particularly suited for the dispensing of juice, milk, or other soft drinks, such applications are examples only. The teachings herein apply as well to the dispensing or pumping of any suitable liquid or semi-liquid (either being referred to herein as a "liquid"), including, without limitation, concentrates, syrups, beverages, milks, cheeses, condiments, soups, sauces, pharmaceuticals, and other edible or drinkable products. Also, although the product contained in package 12 is often concentrated, so as to be mixed with a diluent such as water, the package may contain any single strength product suitable for dispensing without such mixing.

Within this description, coupling includes both direct coupling of elements, and coupling indirectly through intermediate elements.

The particular embodiments and descriptions provided herein are illustrative examples only, and features and advantages of each example may be interchanged with, or added to the features and advantages in the other embodiments and examples herein. Moreover, as examples, they are meant to be without limitation as to other possible embodiments, are not meant to limit the scope of the present invention to any particular described detail, and the scope of the invention is meant to be broader than any example. Also, the present invention has several aspects, as described above, and they may stand alone, or be combined with some or all of the other aspects.

And, in general, although the present invention has been described in detail, it should be understood that various changes, alterations, substitutions, additions and modifications can be made without departing from the intended scope of the invention, as defined in the following claims.

What is claimed is:

1. A pump assembly. comprising:

a base having an electrical connector;

a motor housing engaged with the base and the electrical connector, the motor housing adapted for sliding disengagement from both the base and the electrical connector in a single sliding motion in a first direction, and engagement with both the base and the electrical connector in a single sliding motion in a second direction opposite to the first direction, the motor housing providing a substantially water-tight seal around a motor, wherein electricity is supplied to the motor through the electrical connector; and a peristaltic pump comprising tube engaging members, the peristaltic pump coupled to the motor and adapted for quick disconnect from the motor.

2. The pump assembly of claim 1, wherein the peristaltic pump is adapted to slidingly engage with a pump housing receiver, and wherein the pump housing receiver is adapted to slidingly engage with the base.

3. The pump assembly of claim 2. wherein the pump housing receiver is integrated with the motor housing.

4. The pump assembly of claim 1. wherein the peristaltic pump pumps liquid through a flexible tube resulting in displacement of the tube, and further comprising a sensor operable to sense the displacement.

5. The pump assembly of claim 1. and further comprising:

a performance identifier coupled to the peristaltic pump: and a sensor operable to sense the performance identifier and generate a signal in response to the performance identifier, wherein the motor is controlled in response to the signal.

6. The pump assembly of claim 5, wherein the peristaltic pump is a wave pump having a rotor assembly. and wherein the performance identifier is a magnet rotating with the rotor assembly.

7. The pump assembly of claim 5, and further comprising a home identifier spaced apart from the performance identifier, and wherein the sensor is further operable to sense the home identifier.

8. The pump assembly of claim 1, and further comprising a sensor operable to determine whether the peristaltic pump is operating when the motor is on.

9. The pump assembly of claim 8. wherein the peristaltic pump includes a rotor assembly, and wherein the sensor is a hall-effect sensor sensing rotation of the rotor.

10. A peristaltic pump, comprising:

a tube through which a material to be pumped flows;

a motor;

one or more compression heads coupled to the motor and adapted to compress the tube for pumping the material in a desired flow direction;

a performance identifier coupled to the peristaltic pump, wherein the performance identifier identifies a deviation of the pump's performance from a target pumping performance; and a sensor operable to read the performance identifier and generate a signal in response to the performance identifier, wherein the motor is controlled in response to the signal such that the speed of the motor is controlled based on the identified deviation to achieve enhanced pumping performance.

11. The pump of claim 10. wherein the peristaltic pump is a wave pump having a rotor assembly, and wherein the performance identifier is a magnet rotating with the rotor assembly.

12. The pump of claim 10, and further comprising a home identifier spaced apart from the performance identifier, and wherein the sensor is further operable to sense the home identifier.

* * * * *